US005249022A

United States Patent [19]

Watanabe et al.

[11] Patent Number: 5,249,022

[45] Date of Patent: Sep. 28, 1993

[54] IMAGE FORMING DEVICE HAVING AN ELECTRICALLY DIELECTRIC REGULATING MEMBER CONDUCTIVE TRANSFER MEMBER AND A DISPOSED AT A TRANSFER STATION THEREOF

[75] Inventors: Akira Watanabe, Yokohama; Tatsuo Takeuchi, Kawasaki; Kenichiro Waki; Yasushi Miura, both of Kawasaki; Takeo Tsunemi, Yokohama, all of Japan

[73] Assignee: Canon Kabushiki Kaisha, Tokyo, Japan

[21] Appl. No.: 795,810

[22] Filed: Nov. 21, 1992

[30] Foreign Application Priority Data

| | | | |
|---|---|---|---|
| Nov. 21, 1990 | [JP] | Japan | 2-317415 |
| May 22, 1991 | [JP] | Japan | 3-145195 |
| Jun. 13, 1991 | [JP] | Japan | 3-168893 |

[51] Int. Cl.[5] ..... G03G 15/14

[52] U.S. Cl. ..... 355/271; 355/273; 355/274

[58] Field of Search ..... 355/271, 219, 273–277, 355/326, 327; 361/220, 221, 225, 230

[56] References Cited

U.S. PATENT DOCUMENTS

| | | | |
|---|---|---|---|
| 3,850,519 | 11/1974 | Weikel, Jr. | 355/274 X |
| 4,513,683 | 4/1985 | Kisler | 361/221 X |
| 4,545,669 | 10/1985 | Hays et al. | 355/220 X |
| 4,547,060 | 10/1985 | Lindblad | 355/219 |
| 4,555,171 | 11/1985 | Clouthier et al. | 361/255 X |
| 4,575,216 | 3/1986 | Hebert et al. | 355/274 |
| 4,847,652 | 7/1989 | Masuda et al. | 355/274 |
| 4,998,143 | 3/1991 | Kumasaka et al. | 355/271 |
| 5,081,501 | 1/1992 | Waki et al. | 355/274 |
| 5,091,751 | 2/1992 | Inoue et al. | 355/274 |

FOREIGN PATENT DOCUMENTS

| | | |
|---|---|---|
| 382448 | 8/1990 | European Pat. Off. . |
| 400996 | 12/1990 | European Pat. Off. . |
| 56-133765 | 10/1981 | Japan . |
| 60-216361 | 10/1985 | Japan . |
| 61-232478 | 10/1986 | Japan . |
| 2-010390 | 1/1990 | Japan . |
| 2-039183 | 2/1990 | Japan . |
| 2-148075 | 6/1990 | Japan . |
| 2-189570 | 7/1990 | Japan . |

OTHER PUBLICATIONS

European Search Report.

*Primary Examiner*—A. T. Grimley
*Assistant Examiner*—William J. Royer
*Attorney, Agent, or Firm*—Fitzpatrick, Cella, Harper & Scinto

[57] ABSTRACT

The present invention provides an image forming apparatus including an image bearing member; image forming devices for forming a toner image on the image bearing member, the average volume particle diameter of the toner being 3–10 μm; a movable transfer sheet bearing member for bearing a transfer sheet; and a transfer member for transferring the toner image formed on the image bearing member onto the transfer sheet carried by the transfer sheet bearing member at a transfer station. The transfer member includes a fiber brush engageable by the transfer sheet bearing means at a side opposite to the image bearing member at the transfer station.

16 Claims, 9 Drawing Sheets

IMAGE FORMING DEVICE HAVING AN ELECTRICALLY DIELECTRIC REGULATING MEMBER CONDUCTIVE TRANSFER MEMBER AND A DISPOSED AT A TRANSFER STATION THEREOF

BACKGROUND OF THE INVENTION

1. Field of the Invention

The present invention generally relates to a black and white, mono-color or full-color image forming apparatus, and more particularly, it relates to a full-color image forming apparatus such as a full-color electrophotographic copying machine, printer and the like, wherein an image is obtained by transferring and superimposing visualized images or toner images formed on an image bearing member by an electrophotographic technique or an electrostatic recording technique on a transfer sheet carried by a transfer sheet bearing member by the use of the transfer electric field.

2. Related Background Art

In the past, various kinds of full-color image forming apparatuses have been proposed. In such image forming apparatuses, an electrostatic latent image is formed on a photosensitive drum acting as an image bearing member and then is visualized as a toner image with yellow toner (having an average volume particle diameter of 11.0–14.0 μm) contained in one of a plurality of developing devices. The yellow toner image is transferred onto a transfer sheet carried by a transfer drum acting as a transfer sheet bearing member at a transfer station. The transfer drum includes a pair of cylinders arranged on respective ends, a connecting portion connecting these cylinders to each other, and a dielectric sheet (transfer sheet bearing member) for covering an opening obtained by cutting off the drum portion while retaining the cylinders and the connecting portion. In order to transfer the image onto the transfer sheet at the transfer station, a transferring corona discharger (transfer member) comprising a wire electrode and a shield electrode surrounding the wire electrode is disposed within the transfer drum. Magenta, cyan and black toner images are formed on the image bearing members in the same manner as the yellow toner image, and the same transfer sheet is brought to the transfer station four times to transfer these four color toner images thereonto. After these four color toner images have been transferred onto the transfer sheet, the sheet is separated from the transfer drum. Thereafter, the transfer sheet is sent to a fixing device, where the four color toner images are melted and combined to form a full-color image fixed to the transfer sheet.

In the above-mentioned conventional technique, although the image obtained by the full-color electrophotographic copying machine which has been practically used provides improved image quality regarding the color reproductibity and the color tone reproductibity, it is hard to say that the image is closely reproduced from the color original. Further, unlike a television image, photo-image or color printed matter image, since the reproduced or copied image is not immediately compared with the actual object, the images obtained by the full-color electrophotographic copying machines which have been practically used are not necessarily satisfactory for persons who are accustomed to seeing images which are made more beautiful than the actual images.

Although techniques in which toner having a smaller particle diameter is used for improving the image quality have been developed, if the toner having a smaller particle diameter is used in the above-mentioned conventional image forming apparatus, since the corona discharger is used to transfer the toner image onto the transfer sheet, the following problems arise.

Generally, as the diameter of the toner particle is decreased, the BET specific surface area measured by the nitrogen gas adsorption technique is increased, so that the friction charging feature of the toner regarding the friction chargeable members such as carriers in developer, a developing sleeve (developer bearing member) and a regulating member for regulating an amount of the developer on the developing sleeve is enhanced, with the result that an amount of the frictionally charged toner is increased, thus worsening the movement of the toner. Further, when the specific surface area is increased, an amount of moisture adsorbed on the surface is increased, so that the change rate of the friction charging feature of the toner due to the environmental change is also increased, thus increasing the amount of the frictionally charged toner, particularly under the low humidity circumstance.

By way of an example, conventionally, the toner that the distribution of toner particle sizes corresponds to the average volume particle diameter of 11.0–14.0 μm has been used. However, as mentioned above, when the toner having the smaller particle diameter, for example, the toner having the average volume particle diameter of 8.0–4.0 μm and the greater friction charging amount (particularly, under the low humidity circumstance) thereby worsening the movement of the toner is used, the toner is strongly adhered to an electrostatic latent image electrostatically (for example, by the Coulomb force or reflection force), with the result that a stronger transfer electric field or transfer current must be supplied to transfer the toner image onto the transfer sheet. That is to say, conventionally, although high voltage of 6–8 KV was applied from a power source to the wire electrode of the transferring corona discharger so that a part of the total corona discharging current (about 10–30%), i.e., current of a few μA–20 μA is applied toward the photosensitive drum as the transfer current, if the toner having the smaller particle diameter is used as mentioned above, a further stronger transfer current is required.

In view of the construction of the transferring corona discharger, since the transfer current must be applied toward the photosensitive drum via the dielectric shield, the impedance of the corona discharge toward the photosensitive drum becomes very high, with the result that the corona discharge is effected actively between the corona discharger and the shield which is earthed and which has the lower discharge impedance. Consequently, almost all of the total corona discharging current will flow toward the shield. Accordingly, even if the current to be applied is increased to obtain a stronger transfer current, the increment of the transfer current toward the photosensitive drum will be limited to a certain extent. Thus, it is required to provide not only a power source having a greater voltage capacity and current capacity but also to use insulators having greater pressure resistance for the wiring, thereby making the apparatus bulky and expensive.

Further, since transferring corona discharger is used, the corona discharge is generated to produce ozone and nitrogen oxides which cause a bad influence upon the photosensitive drum. Further, in the case where the corona discharge has the positive polarity (i.e., the toner, has the negative polarity), if the corona application voltage is too high, the streamer discharge will occur immediately between the discharging wire and the shield having the lower impedance, thus causing irregularity in the discharge which leads to distortion of the transferred image.

Incidentally, if the transfer sheet is contacted to the dielectric sheet by using a conductive metal sheet or a conductive roller (referred to as "conductive contacting member" hereinafter) to which the voltage is applied, in place of the corona discharger, the above problem can be eliminated. That is to say, in this case, unlike to the corona discharger, almost all of the discharging current does not flow toward the shield, and thus, the transfer of the toner onto the transfer sheet can be achieved with the low potential, low current and high efficiency without producing ozone. However, if such conductive contacting member is used, since the transfer sheet is engaged by such member with straight line contact, the sheet is also contacted by the dielectric sheet with straight line or surface contact. In this condition, although it appears macroscopically that the transfer sheet is uniformly contacted with the dielectric sheet, microscopically, an irregular contacting condition between the transfer sheet and the dielectric sheet along the longitudinal direction of the photosensitive drum arises.

Accordingly, if a low voltage is applied to the conductive contacting member, the transfer charging current will be insufficient at weaker contacting areas (between the transfer sheet and the dielectric sheet), with the result that there is a difference in the transferring efficiency along the longitudinal direction of the photosensitive drum. Consequently, in the toner image transferred to the transfer sheet, there arises an irregularity in the toner density along a direction parallel to an advancing direction of the transfer sheet. On the other hand, if a high voltage is applied to the conductive contacting member, the space discharge will be generated at the weaker contacting areas where there are microscopic spaces between the dielectric sheet and the conductive contacting member, thus creating an irregularity in the toner density, discharge unevenness and/or transfer void in the transferred image. Accordingly, the proper voltage applicating condition is limited to a narrower range.

Further, even within the proper voltage applicating condition, the difference in the contacting condition between the conductive contacting member and the dielectric sheet leads in a difference in the transferring efficiency. Thus, even if the mono-color image has a slight irregularity in the toner densiy, when such images are superimposed on the single transfer sheet to form the multi-color toner image by using the multi-color image forming apparatus, the irregularity in the toner density will be noticeable.

In order to eliminate or reduce the difference in the contacting condition between the conductive contacting member and the dielectric sheet, the contacting pressure between the dielectric sheet and the conductive contacting member may be increased. However, if the contacting pressure is too high, the dynamic friction force between the conductive contacting member and the dielectric sheet will be increased to increase the load acting on the dielectric sheet, with the result that the dielectric sheet is displaced or distorted, thus displacing or distorting the transfer sheet carried by the dielectric sheet. Consequently, when this technique is applied to the multi-color image forming apparatus wherein various color toner images are transferred and superimposed on the single transfer sheet, there arises a discrepancy in colors and/or an irregularity in the color density in the multi-color image. Further, during the transferring operation, since the toner is strongly urged against the photosensitive drum, the transferring efficiency is decreased, and the service lives of the dielectric sheet and of the conductive contacting member are shortened, resulting in the frequent replacement of them, which increases the cost.

Further, when the transfer drum as mentioned above is used, if the contacting pressure between the dielectric sheet and the conductive contacting member is high, whenever members thicker than the dielectric sheet (such as the connecting portion for supporting the cylinders on both ends of the drum, and grippers for gripping a leading end of the transfer sheet) pass through the contacting area, a strong impact occurs at the leading and trailing ends of such members, thus scattering the toner on the transfer sheet or causing a discrepancy in colors in the image. In addition, since the conductive contacting member has a sheet-shape or roller-shape, it cannot be re-contacted with the dielectric sheet immediately after it passes through the trailing ends of the connecting portion and the grippers. Particularly, since it is difficult to attain proper contact between the trailing ends of the connecting portion and the grippers, and the dielectric sheet, the transferring efficiency is considerably worsened at the leading end of the transfer sheet, i.e., at the leading end of the image, thus causing a transfer void at the leading end of the image.

SUMMARY OF THE INVENTION

An object of the present invention is to provide an image forming apparatus which can form an image with high quality without any transfer drawbacks such as the irregularity in image density, discharge unevenness, irregularity in color, discrepancy in colors, scattering of toner and/or transfer void at the leading end of the image, even when toner having a small particle diameter is used.

Another object of the present invention is to provide an image forming apparatus which can utilize a current supplied from a power source to a transfer member as a transfer current without wastefulness.

A further object of the present invention is to provide an image forming apparatus which can form an image with a low cost without producing ozone by supplying a low voltage and a low current to a transfer member.

A still further object of the present invention is to provide an image forming apparatus having a high transferring efficiency and wide transfer latitude.

A further object of the present invention is to provide an image forming apparatus wherein a transfer sheet closely and uniformly contacts an image bearing member with a low pressure during a transferring operation.

Other objects and characteristics of the present invention will be apparent from the following descriptions.

DETAILED DESCRIPTION OF THE PREFERRED EMBODIMENTS

The present invention will now be explained in connection with embodiments thereof with reference to the accompanying drawings.

Figure 3:
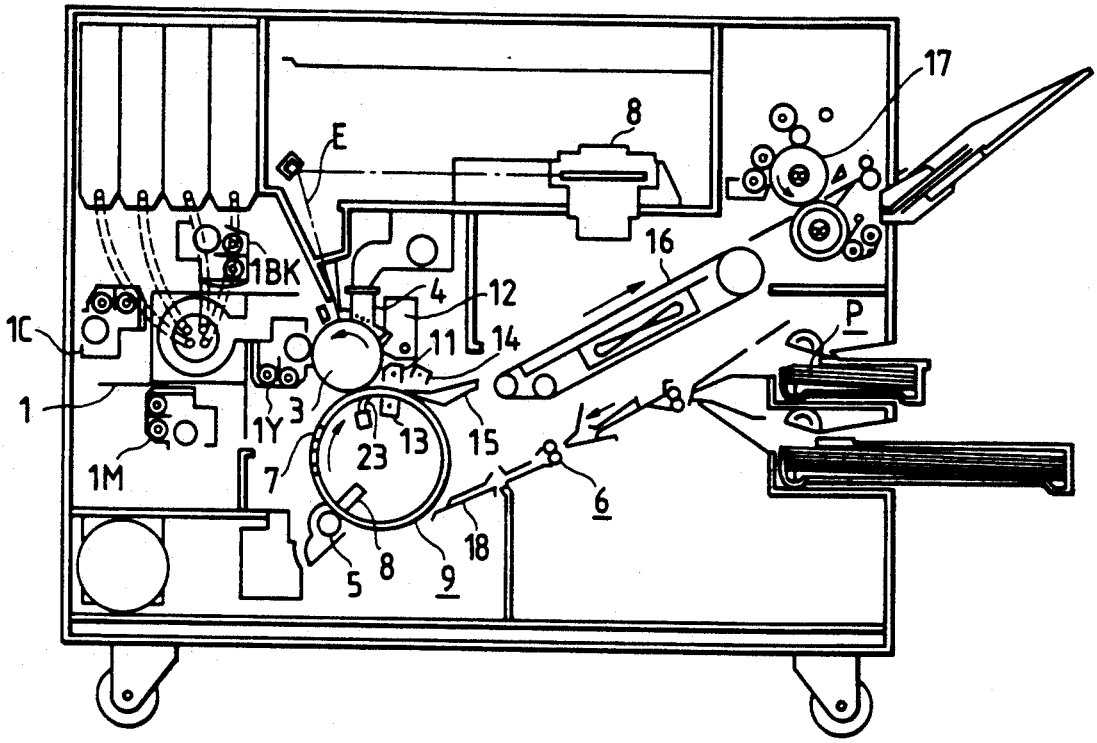
FIG. 3 is an elevational sectional view of a full-color electrophotographic copying machine embodying the present invention.

FIG. 3 is an elevational sectional view of a full-color electrophotographic copying machine embodying an image forming apparatus according to the present invention. The electrophotographic copying machine comprises a photosensitive drum (image bearing member) 3 rotatably mounted and rotated in a direction shown by the arrow, and an image forming means disposed around the drum. Although the image forming means may be of any type, in the illustrated embodiment, it includes a primary charger 4 for uniformly charging the photosensitive drum 3, an exposure means 8 such as a laser beam exposure device for illuminating color decomposed (color separated) light images or other light images equivalent to them onto the photosensitive drum 3 in response to image information from an original and the like to form an electrostatic latent image on the drum 3, and a rotary developing device 1 for visualizing the electrostatic latent image on the photosensitive drum 3.

The rotary developing device 1 comprises four developer containers 1Y, 1M, 1C, 1BK containing yellow color developer, magenta color developer, cyan color developer and black color developer, respectively, and a substantially cylindrical housing rotatably mounted and supporting these four developer containers 1Y, 1M, 1C, 1BK. The rotary developing device 1 is designed so that a desired developer container is brought into a position confronting an outer peripheral surface of the photosensitive drum 3 to develop the electrostatic latent image on the drum with the developer contained in that container, so that four-color images can be obtained.

Figure 4:
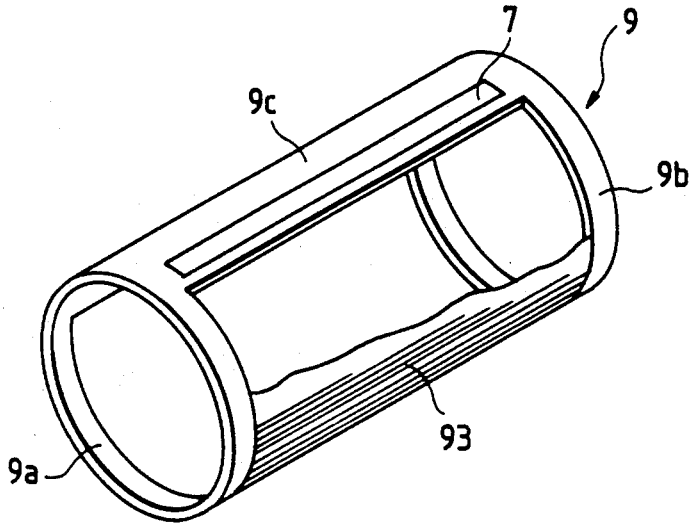
FIG. 4 is a perspective view of a transfer drum.

The visualized image or toner image on the photosensitive drum is transferred onto a transfer sheet P fed and carried by a transfer device 9. In the illustrated embodiment, the transfer device 9 is constituted by a transfer drum rotatably mounted, and, as best seen in FIG. 4, the transfer drum 9 comprises a frame comprised of a pair of cylinders 9*a*, 9*b* disposed on respective ends of the drum and a connecting portion 9*c* connecting the cylinders 9*a*, 9*b* to each other, and a transfer sheet bearing member 93 covering an opening obtained by cutting off the drum portion while retaining the cylinders 9*a*, 9*b* and the connecting portion 9*c*. The transfer sheet bearing member 93 is constituted by a film-shaped dielectric sheet having a thickness of 150 μm and made of, for example, polyvinylidene fluoride resin and the like. Further, a gripper 7 for gripping a leading end of the transfer sheet P supplied from a sheet supply means is formed on the connecting portion 9*c*. Further, within the transfer drum 9, there are disposed a transfer member 23 at a position where this drum is contacted with the photosensitive drum 3, and an inner charge removing discharger 13 at a downstream side of the transfer member in a rotational direction of the transfer drum. And, outer charge removing dischargers, 11, 14 are also arranged outside of the transfer drum in correspondence to the inner discharger 13. The connecting portion extends in a direction perpendicular to a shifting direction of the transfer drum and can be contacted with the transfer member 23 as the transfer drum is rotated.

Now, a method for forming a full-color image by using the full-color electrophotographic copying machine as mentioned above will be briefly described.

After the photosensitive drum 3 is uniformly charged by the primary charger 4, an electrostatic latent image is formed on the photosensitive drum 3 by illuminating the light image E corresponding to the image information onto the drum by means of the exposure means 8. The electrostatic latent image is visualized on the photosensitive drum 3 with resin-based toner having an average volume particle diameter of 6.0 μm by means of the rotary developing device 1.

On the other hand, the transfer sheet P is fed to the transfer drum 9 through a sheet supply guide 18 by means of a pair of register rollers 6 in synchronism with the image. The leading end of the transfer sheet P is gripped by the gripper 7, and then the sheet is conveyed by the transfer drum 9 in the direction shown by the arrow. Then, by supplying a charge having a polarity opposite to that of the toner to the transfer sheet from the back of the transfer sheet bearing member or dielectric sheet 93 by means of the transfer member 23, the toner image on the photosensitive drum 3 is transferred onto the transfer sheet P.

After a predetermined number of transferring processes have been completed, the charge is removed from the transfer sheet by the dischargers 11, 13, 14 and the transfer sheet P is separated from the transfer drum 9 by means of a separating pawl 15. Then, the separated transfer sheet is conveyed by a convey belt 16 toward a fixing device 17, where the various color toner images transferred and superimposed on the transfer sheet are fused and combined to form a full-color image on the transfer sheet. Thereafter, the transfer sheet is ejected out of the machine.

On the other hand, after the transferring operation, the residual toner remaining on the photosensitive drum 3 is removed by a cleaning device 12 for the preparation for the next image forming operation. Further, the surface of the dielectric sheet of the transfer drum 9 is cleaned by a cleaning device 5 comprising a fur brush and an auxiliary cleaning means 8 for the preparation for the next image forming operation.

Figure 1:
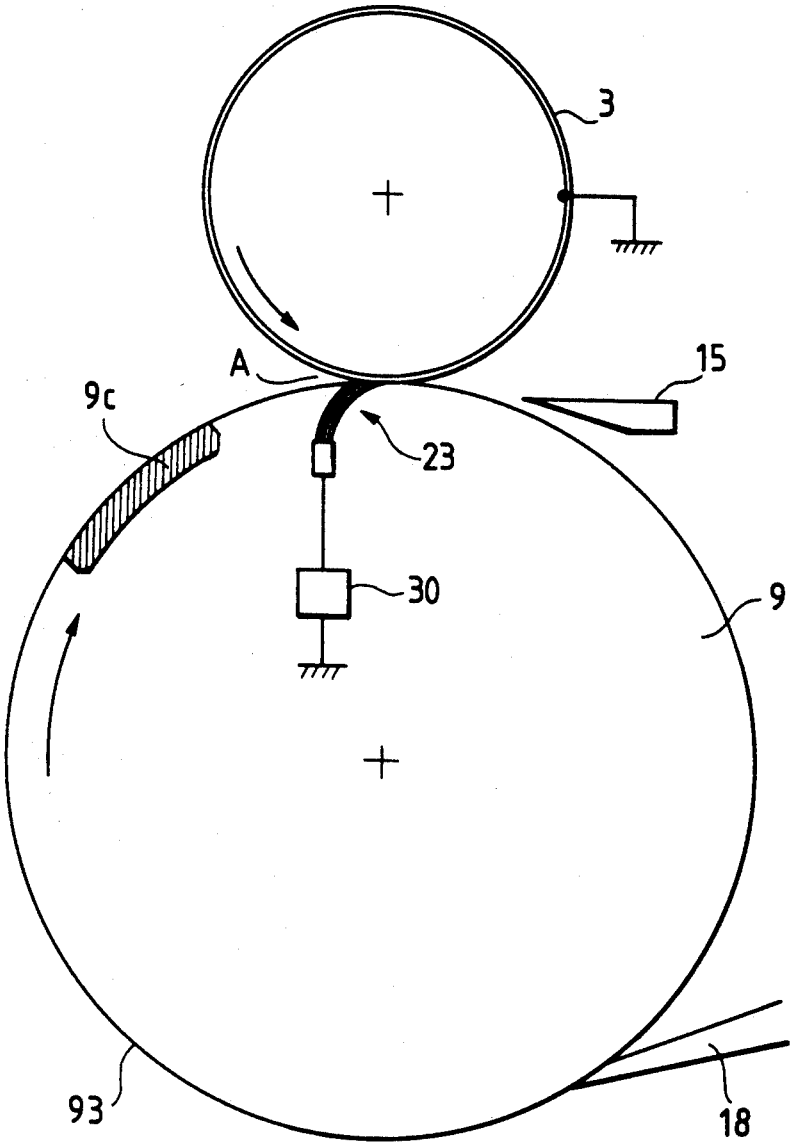
FIG. 1 is an elevational sectional view of a transfer station of an image forming apparatus according to a first embodiment of the present invention.

The transfer member will be further described in detail with reference to FIG. 1 showing an elevational view of a portion near the transfer station of the copying machine of FIG. 3.

As seen in FIG. 1, a conductive brush (conductive contacting member) 23 which is an embodiment of the transfer member is disposed within the transfer drum 9 and is urged against the back of the dielectric sheet 93 at a position where the photosensitive drum 3 is contacted to the transfer drum. The conductive brush 23 is connected to a bias voltage source 30 which applies the transfer electric field to the brush.

In this embodiment, while the conductive brush was constituted by conductive fibers obtained by dyeing acrylic fine fibers with copper sulfide and by making the fibers conductive, any other conductive or semiconductive fibers, such as stainless steel fibers each having a diameter of 8–15 μm, electroplated resin fibers such as acrylic resin, nylon, polyester rayon or the like, fibers obtained by kneading or mixing resin with conductive powder such as carbon powder, metal powder and the like, or carbon fibers obtained by carbonizing resin fibers may be used. The volume resistivity of the conductive brush 23 can be $10^{10}$ Ωcm or less and preferably is $10^{8}$ Ωcm or less.

The conductive brush 23 having an elasticity is arranged so that it extends from an upstream side to a downstream side of a moving direction of the dielectric sheet 93 and is urged against the dielectric sheet 93 at or near a position where the transfer sheet carried by the dielectric sheet 93 starts to separate from the photosensitive drum, or, at or near a position where the transfer sheet starts to contact the photosensitive drum.

Unlike the above mentioned conventional contacting condition between the dielectric sheet and the conductive contacting member, wherein the sheet-shaped or roller-shaped conductive contacting member contacts the dielectric sheet with line or surface contact, according to the present invention, since the contacting condition between the dielectric sheet 93 and the conductive brush 23 is accomplished by contacting each of the elastic fine fibers with the dielectric sheet 93 individually, the brush can follow the surface of the dielectric sheet regardless of the difference in the contacting pressure along the longitudinal direction of the contacting area, the difference in roughness of the surface of the dielectric sheet 93 and/or the step due to the existance of the connecting portion 9c, so that the individual fibers can contact the dielectric sheet uniformly and softly. Further, in consideration of the diameter, material and density of the fibers, a more uniform and soft contacting condition can be attained without increasing the contacting pressure.

During the transferring operation, a voltage is applied from the bias voltage source 30 to the conductive brush 23 to transfer the toner image on the photosensitive drum 3 onto the transfer sheet carried by the dielectric sheet 93.

When the transfer electric field generating means as mentioned above was incorporated into the full-color electrophotographic copying machine of FIG. 3, a toner image was obtained with inversion phenomenon by forming the electrostatic latent image on the photosensitive drum 3 negatively charged and by using a toner having an average volume particle diameter of 6.0 μm. In the present invention, the available average volume particle diameter of the toner is 10.1–3.0 μm and is preferably 8–5 μm. When the average volume particle diameter of the toner exceeds 10.0 μm, the toner can be used with a conventional transfer member, as well as that of the present invention. In addition, if the average particle diameter of the toner is smaller than 3.0 μm, pulverized particles are increased in the manufacture of the toner, with the result that the fog phenomenon and/or deterioration of the image are caused, and much time and energy are required for powdering the toner, thus increasing the cost.

The average volume particle diameter of the toner is measured as follows. The Corta counter TA-II type (manufactured by Corta Inc. in U.S.A.) was used as a measuring means, to which an interface (manufactured by Hitachi Co. in Japan) for outputting average number distribution and average volume distribution and a CX - 1 personal computer (manufactured by Canon Co. in Japan) were connected. Electrolytic solution was prepared by diluting the first class sodium chloride with water to obtain aqueous solution including 1% NaCl. A surface-active agent, preferably alkyl benzene sulfonate, of 0.1–5 ml was added to the electrolytic solution of 100–150 ml as dispersant, and a sample of 0.5–50 mg was further added to the solution. The electrolytic solution suspending the sample therein was subjected to a dispersion treatment by the supersonic dispersing device for 1–3 minutes. Then, the particle size distribution of particles of 1–40 μm was measured by the Corta counter TA - II by using apertures of 100 μm and 8 μm, thus seeking the average volume distribution and the average number distribution.

The average volume particle diameter was determined by the average volume distribution and the average number distribution so obtained.

The toner used in this embodiment was constituted by resin, dye and a small amount of additive for improving the charge controlling ability and the lubricativity and was negatively charged by frictionally contacting the carrier particles in the developer container. In this case, the frictional charging amount of the toner was measured by means of a Faraday gauge by directly sucking the toner image formed on the photosensitive drum 3 into the gauge. As a result, the frictional charging amount of the toner was about −10 to −45 μc/g. Incidentially, in the conventional technique, the frictional charging amount of the toner was about −10 to −25 μc/g.

The toner image formed as mentioned above was then transferred onto the transfer sheet by the transferring means according to the illustrated embodiment. Then, the transfer sheet was separated from the dielectric sheet 93 and was subjected to a fixing treatment by the fixing device 17 to obtain a mono-color image. Further, after a plurality of toner images were sequentially transferred onto the transfer sheet by repeating the above-mentioned processes, the transfer sheet was separated from the dielectric sheet 93 and was subjected to a fixing treatment by the fixing device 17 to obtain a full-color image.

Both the mono-color and full-color images were excellent, without the irregularity in image density, discharge unevenness or void, irregularity in color, discrepancy in colors, scattering of toner and transfer void at the leading end of the image, which was caused in the above-mentioned conventional technique. The same test was performed under the low humidity condition of 10% RH in 15° C. which is severe for the discharging phenomenon. Also in this case, the excellent images could be obtained. In this case, the frictional charging amount of the toner was about −45 μc/g.

In the illustrated embodiment, the diameter of the cylindrical dielectric sheet 93 was 160 mm, the moving speed of the dielctric sheet was 160 mm/sec, the diameter of the photosensitive drum 3 was 80 mm, and the moving speed of the photosensitive drum was 160 mm/sec. The transfer bias voltage applied to the conductive brush 23 might be +0.7~3.5 KV, and the current value might be a few μA-35 μA. This leads to a remarkable reduction in the capacity of the power source and a remarkable reduction in cost, in comparison with the transferring operation using the corona discharger (having the total discharge current value of about +500 μA).

Figure 2:
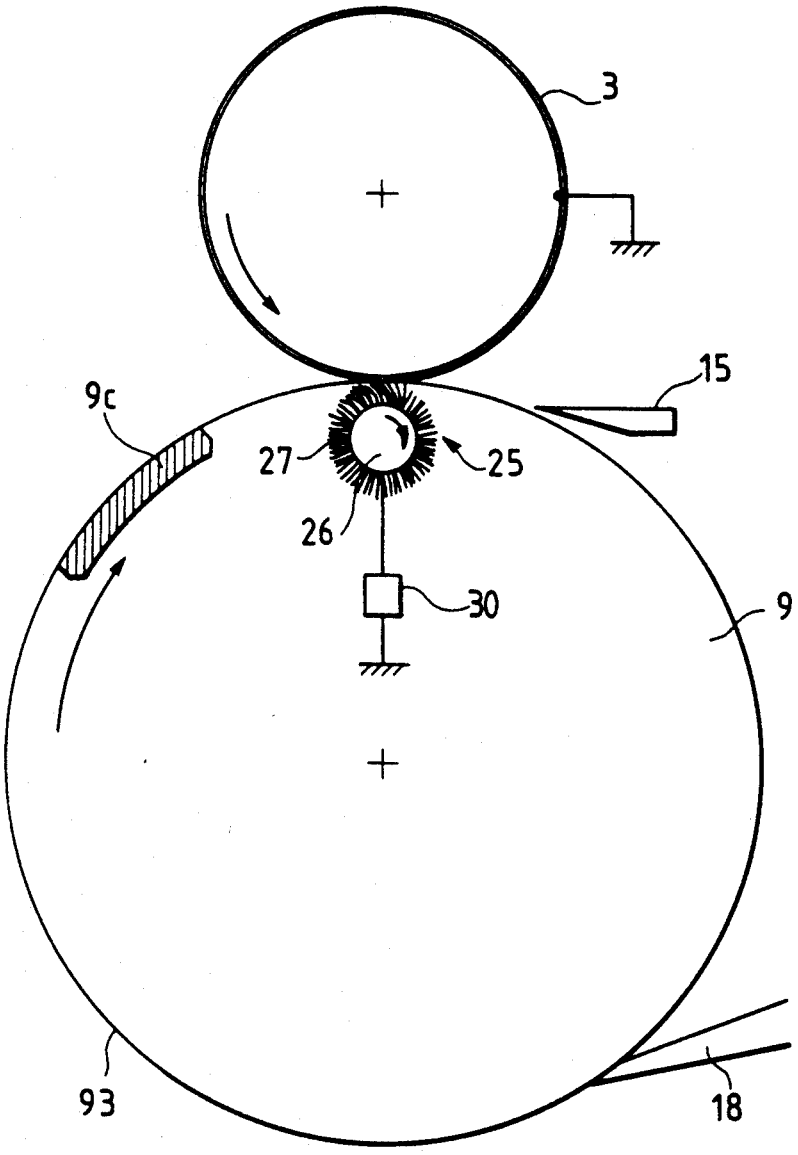
FIG. 2 is an elevational sectional view of a transfer station of an image forming apparatus according to a second embodiment of the present invention.

FIG. 2 shows a second embodiment of the present invention. In this embodiment, in place of the fixed conductive brush 23 in the first embodiment, a roller-shaped conductive brush, i.e., a conductive fur brush roller 25 is used. The other elements are the same as those in the first embodiment, and, thus, the explanation thereof will be omitted.

The conductive fur brush roller 25 comprises a metal core 26 having a diameter of 8 mm, and a cloth web which is closely adhered around the metal core and on which a large number of conductive fibers 27 are closely mounted. Each fiber 27 has a length of 5 mm to define the outer diameter of the roller to 18 mm. While the conductive fibers 27 were obtained by dyeing acrylic fine fibers with copper sulfide and by making the fibers conductive, any other conductive or semiconductive fibers, such as stainless steel fibers each having a diameter of 8-15 μm, electroplated resin fibers such as acrylic resin, nylon, polyester rayon or the like, fibers obtained by kneading or mixing- resin with conductive powder such as carbon powder, metal powder and the like, or carbon fibers obtained by carbonizing resin fibers may be used. The volume resistivity of the fur brush roller can be $10^{10}$ Ωcm or less and preferably is $10^{8}$ Ωcm or less.

The conductive fur brush roller 25 having an elasticity is arranged so that it is urged against the dielectric sheet 93 at or near a position between the position where the transfer sheet carried by the dielectric sheet 93 starts to separate from the photosensitive drum and the position where the transfer sheet starts to contact the photosensitive drum. Further, the conductive fur brush roller 25 may be driven at the same speed as that of the moving dielectric sheet 93, or may be rotatingly driven at a speed different from that of the dielectric sheet, if necessary.

Also in this embodiment, as a result of the same test as that in the first embodiment performed by using the conductive fur brush roller 25 as the transfer member, the same technical effect or advantage could be obtained. That is to say, also in this embodiment, excellent images without the irregularity in image density, discharge unevenness or void, irregularity in color, discrepancy in colors, scattering of toner, transfer void at the leading end of the image and distortion of the image could be obtained under various circumstances.

Figure 5:
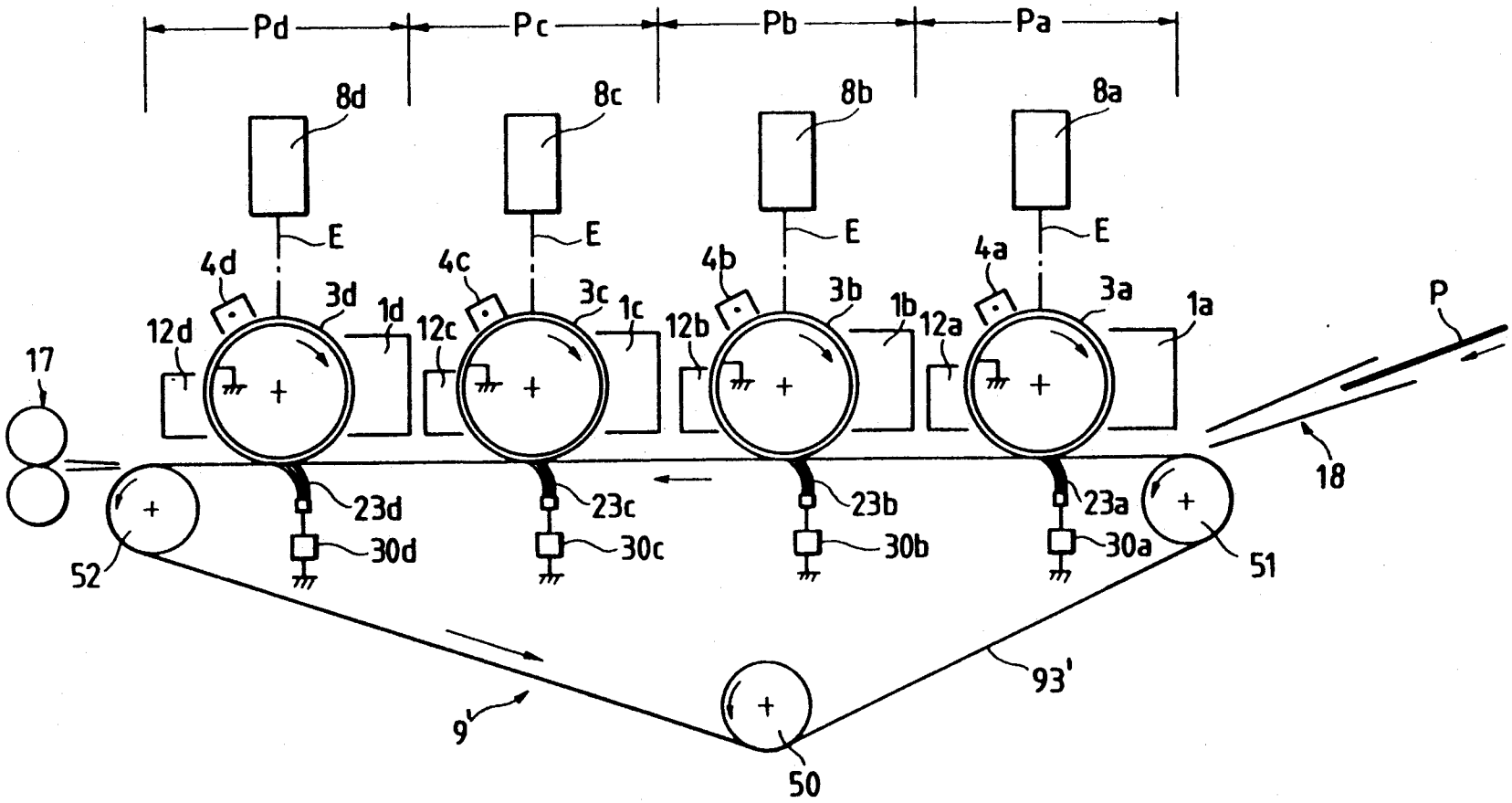
FIG. 5 is a schematic elevational sectional view of an image forming apparatus according to a third embodiment of the present invention.

FIG. 5 shows a third embodiment of the present invention. Although the first and second embodiments were applied to a full-color electrophotographic copying machine having a rotary developing device and a transfer drum was used as the transferring means, in this third embodiment, the present invention is applied to a full-color electrophotographic apparatus having a transfer belt 93' as the transfer device 9'.

Referring to FIG. 5, the full-color electrophotographic apparatus according to the third embodiment comprises first, second, third and fourth image forming portions Pa, Pb, Pc, Pd arranged sequentially within a frame of the apparatus. The image forming portions Pa, Pb, Pc, Pd include exclusive electrophotographic photosensitive drums **3*a*, 3*b*, 3*c*, 3*d*, respectively. Around the photosensitive drums 3*a*, 3*b*, 3*c*, 3*d*, primary chargers 4*a*, 4*b*, 4*c*, 4*d*, exposure means 8*a*, 8*b*, 8*c*, 8*d*, developing devices 1*a*, 1*b*, 1*c*, 1*d* each including toner having the same average volume particle diameter as the aforementioned one, and cleaning devices 12*a*, 12*b*, 12*c*, 12*d* are disposed, respectively. Further, a transfer belt 93 is mounted around rollers 50, 51, 52 and extends therebetween below the photosensitive drums 3*a*, 3*b*, 3*c*, 3*d***. The belt is rotated in a direction shown by the arrow and constitutes a transfer station.

With this arrangement, first of all, a latent image corresponding to an yellow color component of an original image is formed on the photosensitive drum **3*a* of the first image forming portion Pa by means of the primary charger 4*a* and the exposure means 8*a*. Then, this latent image is developed with yellow toner in the developing device 1*a* to form a yellow toner image. The yellow toner image is then transferred onto a transfer sheet P carried by the transfer belt 93' at the transfer station. Although the transfer belt 93'** can be constituted by various kinds of dielectric sheets or composite sheets, in this third embodiment, it is constituted by a sheet made of polyvinylidene fluoride (PVdF) and having a thickness of 150 μm.

On the other hand, while the yellow toner image is being transferred onto the transfer sheet P, a latent image corresponding to a magenta color component of the original image is formed at the second image forming portion Pb. This latent image is then developed with magenta toner in the developing device **1*b* to form a magenta toner image. When the transfer sheet P on which the yellow toner image has been transferred at the first image forming portion 1*a* is brought into a position of the transfer station relating to the second image forming portion 1*b***, the magenta toner image is transferred and superimposed on the transfer sheet P.

In this way, a cyan toner image and a black toner image are sequentially formed at the third and fourth image forming portions Pc, Pd in the same manner as above, and these cyan and black toner images are transferred and superimposed on the same transfer sheet P at predetermined positions. When all of the toner images are transferred onto the single transfer sheet, the superimposed toner images on the transfer sheet are fixed to the sheet P by a fixing device 17 to obtain a full-color image. On the other hand, after each toner image has been transferred from the photosensitive drum to the transfer sheet, the residual toner remaining on each of the photosensitive drum **3*a*, 3*b*, 3*c*, 3*d* is removed by the corresponding cleaning device 12*a*, 12*b*, 12*c*, 12*d*** for the preparation for the next latent image formation.

In the full-color electrophotographic apparatus having the above construction, the transfer sheet P is moved from right to left (FIG. 5) by the transfer belt 93' together with the latter to pass through the image forming portions Pa, Pb, Pc, Pd sequentially.

According to the third embodiment, in place of the conventional corona discharger, conductive brushes **23*a*, 23*b*, 23*c*, 23*d* each having the same construction as that of the first embodiment are used in connection with the 1st to 4th image forming portions. That is to say, in FIG. 5, conductive brushes 23*a*, 23*b*, 23*c*, 23*d* are disposed within the transfer belt 93' in such a manner that these brushes are urged against the back surface of the transfer belt 93** at positions where the photosensitive drums 3a, 3b, 3c, 3d contact the transfer belt, respectively. Further, the conductive brushes 23a, 23b, 23c, 23d are connected to corresponding bias voltage sources 30a, 30b, 30c, 30d for applying transfer electric fields to the conductive brushes 23a, 23b, 23c, 23d, respectively.

In this embodiment, as mentioned above, the conductive brushes 23a, 23b, 23c, 23d are constituted in the same manner as that shown in the first embodiment, and each of the brushes is arranged so that it extends from an upstream side to a downstream side of a moving direction of the transfer belt 93' and is urged against the transfer belt 93' at or near a position where the transfer sheet carried by the transfer belt 93' starts to separate from the corresponding photosensitive drum, or, at or near a position where the transfer sheet starts to contact the corresponding photosensitive drum.

Also in this embodiment, as a result of the same test as that in the first embodiment performed by using the conductive brushes 23 (23a, 23b, 23c, 23d) as the transfer electric field generating means, the same technical effect or advantage could be obtained. That is to say, also in this embodiment, excellent images without the irregularity in image density, discharge unevenness or void, irregularity in color, discrepancy in colors, scattering of toner, transfer void at the leading end of the image and distortion of the image could be obtained under various circumstances. Further, since the frictional load acting on the transfer belt can be maintained to the smaller extent, the displacement, distortion and/or hurting of the transfer belt can be prevented, thus avoiding the distortion of the image due to the hurting of the belt.

Figure 6:
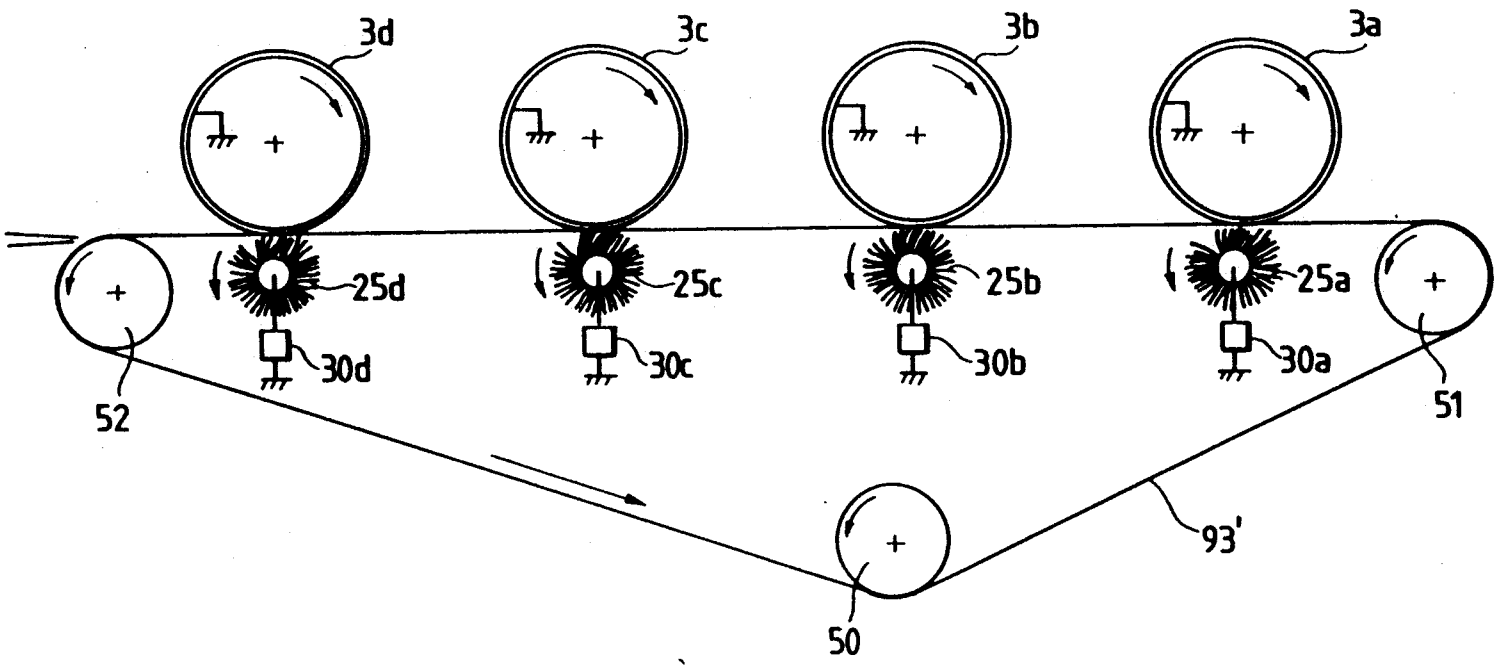
FIG. 6 is a schematic elevational sectional view of an image forming apparatus according to a fourth embodiment of the present invention.

FIG. 6 shows a fourth embodiment of the present invention. In this fourth embodiment, in place of the fixed conductive brushes 23a, 23b, 23c, 23d in the third embodiment, roller-shaped conductive brushes, i.e., conductive fur brush rollers 25 (25a, 25b, 25c, 25d) are used. FIG. 6 shows only characteristic,, portions of the fourth embodiment. The elements that are the same as those shown in FIG. 5 are designated by the same reference numerals, and the detailed explanation thereof will be omitted.

In this embodiment, the conductive fur brush rollers 25a, 25b, 25c, 25d are constituted in the same manner as the conductive fur brush roller 25 in the second embodiment, and are arranged so that each of the conductive fur brush rollers is urged against the transfer belt 93 at or near a position between the position where the transfer sheet carried by the transfer belt 93' starts to separate from the corresponding photosensitive drum and the position where the transfer sheet starts to contact the corresponding photosensitive drum. Further, the conductive fur brush rollers may be driven at the same speed as that of the moving dielectric sheet 93', or may be rotatingly driven at speeds different from that of the dielectric sheet, if necessary.

Also in this embodiment, as a result of the same test as that in the third embodiment performed by using the conductive fur brush rollers 25 as the transfer members, the same technical effect or advantage could be obtained. That is to say, also in this embodiment, excellent images without the irregularity in image density, discharge unevenness or void, irregularity in color, discrepancy in colors, scattering of toner, transfer void at the leading end of the image and distortion of the image could be obtained under various circumstances. Further, since the frictional load acting on the transfer belt can be maintained to the smaller extent, the displacement, distortion and/or hunting of the transfer belt can be prevented, thus avoiding the distortion of the image due to the hunting of the belt.

Figure 7:
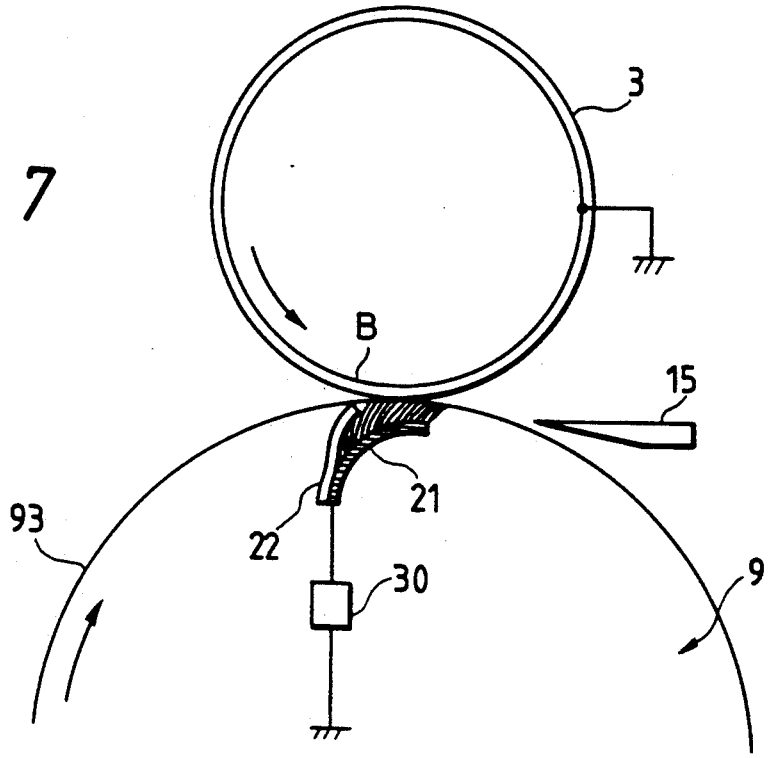
FIGS. 7 to 11 are partial elevational sectional views of transfer stations of image forming apparatuses according to 5th to 9th embodiments of the present invention, respectively.

FIG. 7 shows another embodiment of the transfer member of FIG. 1. The same elements as those shown in FIG. 1 are designated by the same reference numerals, and the detailed explanation thereof will be omitted. For example, in FIG. 1, since the transfer electric field is formed between the photosensitive drum 3 and the conductive brush 23 even at an area (shown by the letter A) upstream of the position where the transfer sheet carried by the dielectric sheet 93 starts to contact the photosensitive drum 3, the discharge phenomenon occurs in a small space near the area A. Thus, it is feared that the toner image on the photosensitive drum 3 is scattered before it is transferred onto the transfer sheet, thus causing transfer unevenness and/or transfer void.

However, in this embodiment, as shown in FIG. 7, an electric field regulating member 22 is attached to the conductive brush 21 between the dielectric sheet 93 and the conductive brush (transfer member) 21 at an upstream side of a position B where the transfer sheet carried by the dielectric sheet 93 starts to contact the photosensitive drum 3. The electric field regulating member 22 serves to weaken or shield the transfer electric field at the upstream side of the transfer position In the illustrated embodiment, the electric field regulating member 22 has a thickness of 50 μm or 75 μm and is made of polyethylene terephthalate; however, it may be constituted by a conventional insulative resin sheet.

With this arrangement, since the voltage is uniformly applied along a longitudinal direction of the conductive brush 21, the electric field regulating member 22 is not charged unevenly, unlike the corona discharge.

The conductive brush 21 was constituted by a sheet made of stainless steel (SUS) and having a thickness of 50 μm, and a number of conductive and elastic fibers upstandingly adhered to the sheet by a conductive adhesive. However, any other conductive or semi-conductive fibers, such as stainless steel fibers each having a diameter of 8–15 μm, electroplated resin fibers, fibers obtained by kneading or mixing resin such as acrylic resin, nylon, polyester rayon or the like with conductive powder such as carbon powder, metal powder and the like, or conductive fibers obtained by dyeing fibers with copper sulfide and by making the fibers conductive. Further, a conductive brush including such fibers may be used. The volume resistivity of the conductive brush 21 can be $10^{10}$ Ωcm or less and preferably is $10^{8}$ Ωcm or less.

In this embodiment, since the area upstream of the conductive brush 21 is regulated by the electric field regulating member 22, the scattering of the toner, transfer unevenness and/or transfer void which are caused due to the above-mentioned discharge phenomenon can be prevented, thus obtaining an excellent image without distortion.

Further, in the illustrated embodiment, as a result of various tests performed by varying the volume resistivity of the dielectric sheet 93, it was found that, when the dielectric sheet having the volume resistivity of about $10^{8}$–$10^{16}$ ≠cm (preferably, $10^{9}$–$10^{12}$ Ωcm) was used, the discharge phenomenon caused by the separation of the transfer sheet P from the dielectric sheet 93, and the discrepancy in colors and/or the irregularity in color due to the insufficient adhesion between the dielectric sheet and the transfer sheet were not generated, and the transfer efficiency was satisfactory.

Further, when the dielectric sheet 93 having the volume resistivity smaller than $10^{12}$ Ωcm was used, since the potential generated after the charging due to the transferring operation was quickly reduced, the transferring efficiency in the transferring of 2nd–4th toner images or in the continuous transferring was not reduced, or reduced to a negligible extent. Therefore, it was not required to provide a corona discharger for removing the charge, thus making the apparatus more compact and cheaper, and reducing the generation of ozone.

Further, when the dielectric sheet 93 having the relatively great volume resistivity, for example, of about $10^{16}$ Ωcm was used, by using the dielectric sheet having a dielectric constant of 4 or more, sufficient transfer efficiency could be obtained by a bias voltage of 1.0–3.0 KV which is considerably smaller than the bias voltage of 6–8 KV required for the transferring due to the corona current.

Figure 8:
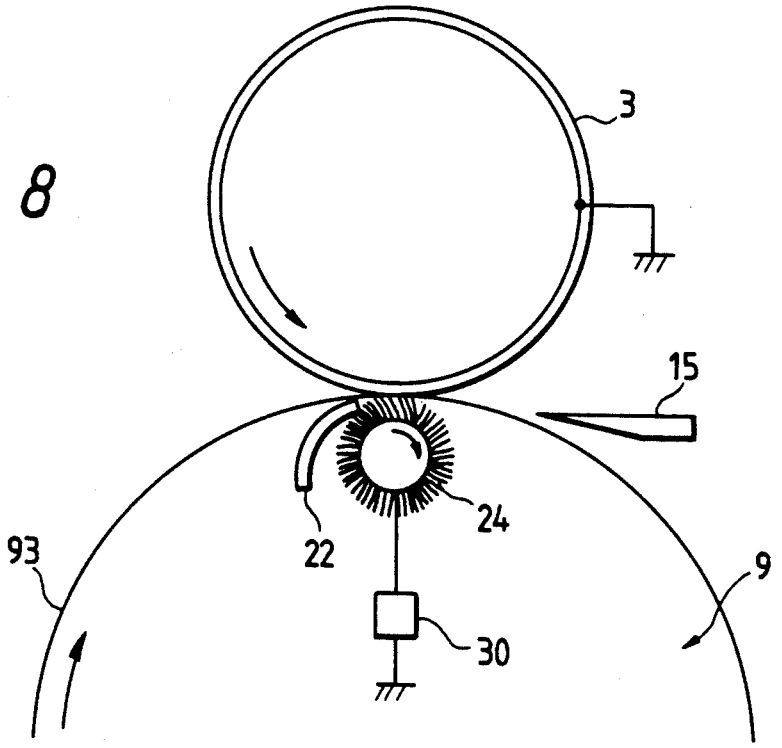

FIG. 8 shows a further embodiment of the present invention. In this embodiment, in place of the conductive brush according to the embodiment of FIG. 7, a conductive fur brush roller 24 is used.

The conductive fur brush roller 24 comprises a metal core having a diameter of 8 mm, and a cloth web which is closely adhered around the metal core with a conductive adhesive and on which a large number of conductive fibers are closely mounted. Each fiber has a length of 5 mm to define the outer diameter of the roller at 18 mm. As the conductive fibers, for example, conductive or semi-conductive fibers, such as stainless steel fibers each having a diameter of 8–15 μm, electroplated resin fibers, fibers obtained by kneading or mixing resin such as acrylic resin, nylon, polyester rayon or the like with conductive powder such as carbon powder, metal powder and the like, or conductive fibers obtained by dyeing fibers with copper sulfide and by making the fibers conductive may be used. The volume resistivity of the conductive fur brush roller 24 can be $10^{10}$ Ωcm or less and preferably is $10^{8}$ Ωcm or less.

Also in this embodiment, since the area upstream of the conductive fur brush roller 24 is regulated by the electric field regulating member 22, the same technical effect or advantage as that of the embodiment of FIG. 7, whereby the scattering of the toner, transfer unevenness and/or transfer void which are caused due to the above-mentioned discharge phenomenon can be prevented, thus obtaining an excellent image without distortion.

Figure 9:
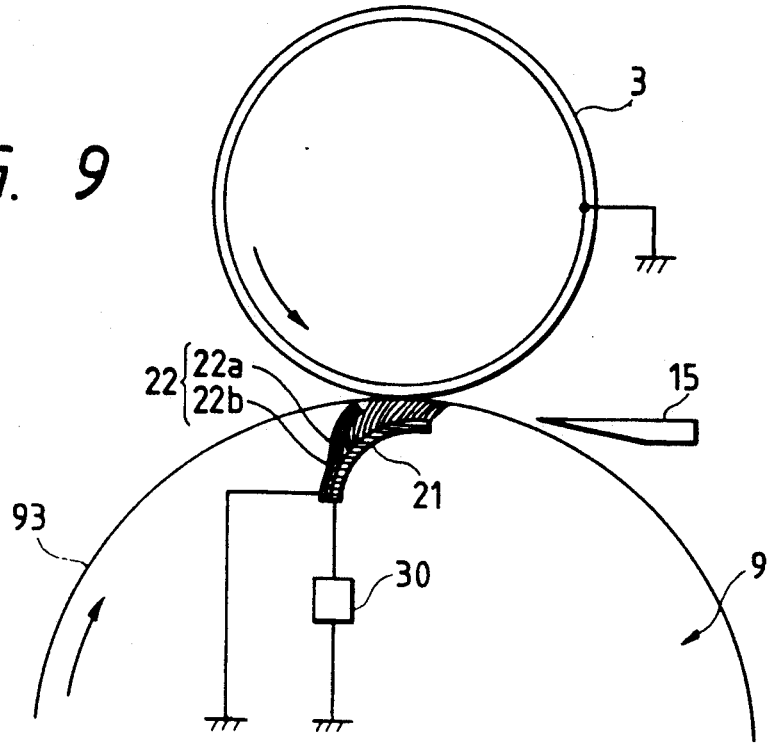

FIG. 9 shows a still further embodiment of the present invention. In this embodiment, in place of the electric field regulating member 22 according to the embodiment of FIG. 7, an electric field regulating member 22 having a two-layer construction comprised of an insulator layer **22*a* and a conductor layer 22*b* is used. The conductor layer 22*b* is insulated from the conductive brush 21** and is earthed.

According to this embodiment, the electric field generated between the photosensitive drum 3 and the conductive brush 21 at an area upstream of the position where the transfer sheet carried by the dielectric sheet 93 starts to be conducted with the photosensitive drum 3 is guarded and blocked by the earthed conductor layer **22*b***.

The electric field regulating member 22 according to this embodiment is formed by depositing a metal chrome (Cr) as the conductor layer **22*b* on one surface of a polyethylene terephthalate (PET) sheet (insulator layer 22*a*) having a thickness of 50 μm. The insulator layer 22*a* may be made of conventional insulative resins other than the PET resin, and the conductor layer 22*b*** laminated onto the insulator layer may be formed from other deposited metals, or may be formed from a conductive or semi-conductive material obtained by dispersing conductive material such as carbon, metal powder and the like in resin or rubber to control the resistive value.

Also in this embodiment, since the area upstream of the conductive brush 21 is regulated by the electric field regulating member 22, the same technical effect or advantage as that of the embodiment of FIG. 7, whereby the scattering of the toner, transfer unevenness and/or transfer void which are caused due to the above-mentioned discharge phenomenon can be prevented, thus obtaining an excellent image without distortion.

In this embodiment, while the electric field regulating member 22 had the two-layer construction comprising the insulator layer **22*a* and the conductor layer 22*b* laminated thereon, since the conductor layer 22*b* is earthed, even when an additional insulator layer for improving the insulation effect is laminated on the conductor layer 22*b***, the same advantage can be obtained.

Figure 10:
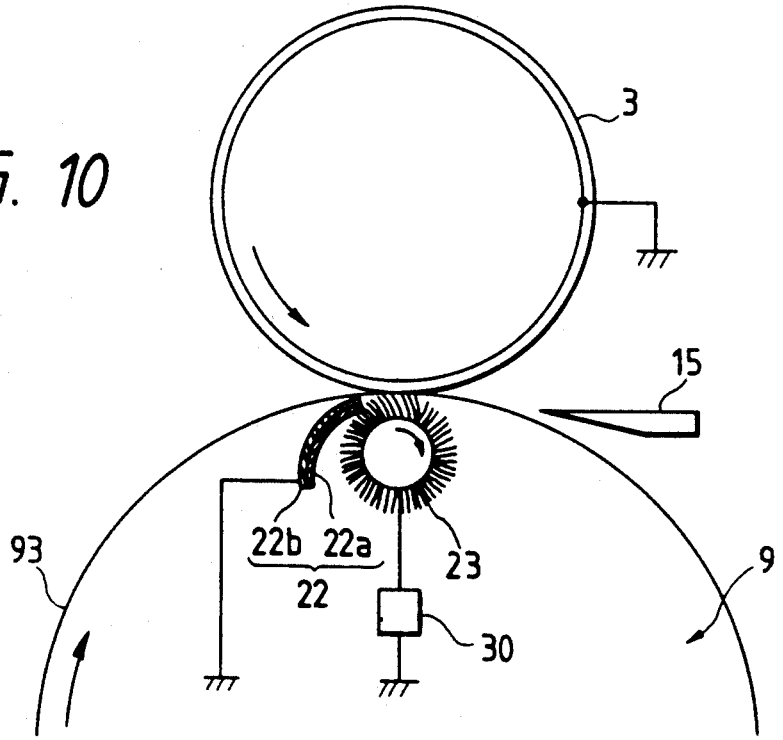

In the other embodiment shown in FIG. 10, in place of the electric field regulating member 22 according to the embodiment of FIG. 8, the electric field regulating member 22 having the two-layer construction comprising the insulator layer **22*a* and the conductor layer 22*b* shown in FIG. 9 is used. Also in this case, the same technical effect or advantage as that of FIG. 9** can be obtained.

The transfer electric field generating means shown in FIGS. 7 to 10 can be applied to the full-color image forming apparatus of FIG. 5, wherein the plurality of photosensitive drums are abutted against the single transfer belt to perform the multiple transferring operations, and the same technical advantage can be expected.

Figure 11:
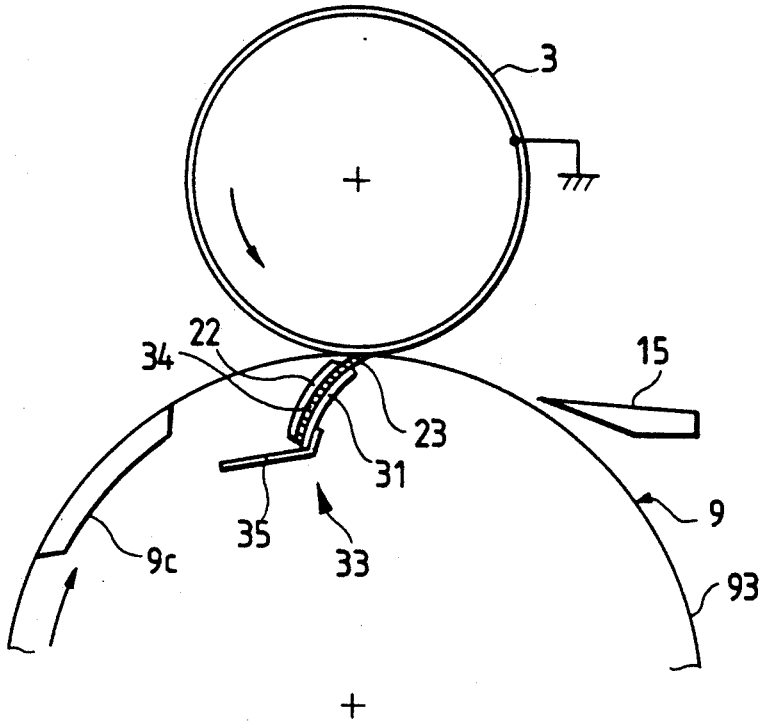

Next, a further embodiment of the transfer electric field generating means which can be applied to the transfer station of the image forming apparatus of FIG. 3 is shown in FIG. 11. Incidentally, the same elements as those in the aforementioned embodiments are designated by the same reference numerals, and the detailed explanation thereof will be omitted.

According to this embodiment, as shown in FIG. 11, a transfer electric field generating means 33 comprising a conductive brush 23, an elastic dielectric sheet 31 and an electric field regulating member 22 is supported by a metal rigid body (in the illustrated embodiment, a support member 35 made of SUS) within a transfer drum 9 at a position where the transfer drum 9 is opposed to the photosensitive drum 3.

The elastic dielectric sheet 31 is mounted on the support member 35, the conductive brush 23 is mounted on the elastic sheet 31 and urged againt the back surface of the dielectric sheet 93, and the electric field regulating member 22 is supported by the support member 35 via a space 34. A free end of the conductive brush 23 is protruded toward the dielectric sheet 93 between the elastic sheet 31 and the electric field regulating member 22. The transfer electric field generating means 33 is inclined from a position at an upstream side of the rotating direction of the transfer drum 9 toward a position where the dielectric sheet 93 is abutted against the photosensitive drum 3, so that, when the support member 35 is turned, the free end of the conductive brush 23 contacts the back surface of the dielectric sheet 93.

The elastic dielectric sheet 31 and the electric field regulating member 22 are formed from polyethylene terephthalate (PET) sheets each having a thickness of 125 μm, 50 μm, respectively. However, the material and thickness of these members are not limited to the above.

With this arrangement, in the transfer electric field generating means 33, the elastic dielectric sheet 31 urges the conductive brush 23 toward the dielectric sheet 93 during the transferring operation, so that the conductive brush 23 and the dielectric sheet 93, the dielectric sheet 83 and the transfer sheet P carried by the dielectric sheet and positioned at the transfer position, and the transfer sheet P and the photosensitive drum 3 are closely contacted to each other, respectively, without any clearance or space therebetween.

The electric field regulating member 22 blocks a part of the transfer electric field generated at the conductive brush 23 by applying the voltage thereto, at an area upstream of the transfer position, thereby limiting an area influenced by the transfer electric field to an area $d_E$ other than the area upstream of the transfer position.

The conductive brush 23 is arranged so that it extends from an upstream side to a downstream side of the moving direction of the dielectric sheet 93 and is urged against the dielectric sheet 93 at or near a position where the transfer sheet P carried, by the dielectric sheet 93 no longer contacts the photosensitive drum 3, or at or near a position where the transfer sheet starts to contact the photosensitive drum. More specifically, the transfer electric field falls within a so-called nip $d_N$ where the transfer sheet P is contacting the photosensitive drum 3. Particularly, if the transfer electric field acts on the transfer sheet P before it contacts the photosensitive drum 3, the distortion of the image will occur by the scattering of the toner due to a so-called pre-transfer. However, in the transfer electric field generating means 33 according to this embodiment, since the transfer electric field area is regulated by the electric field regulating member 22 to prevent the transfer electric field from acting on the transfer sheet P before the latter contacts the photosensitive drum 3, it is possible to prevent the distortion of the image.

Figure 12:
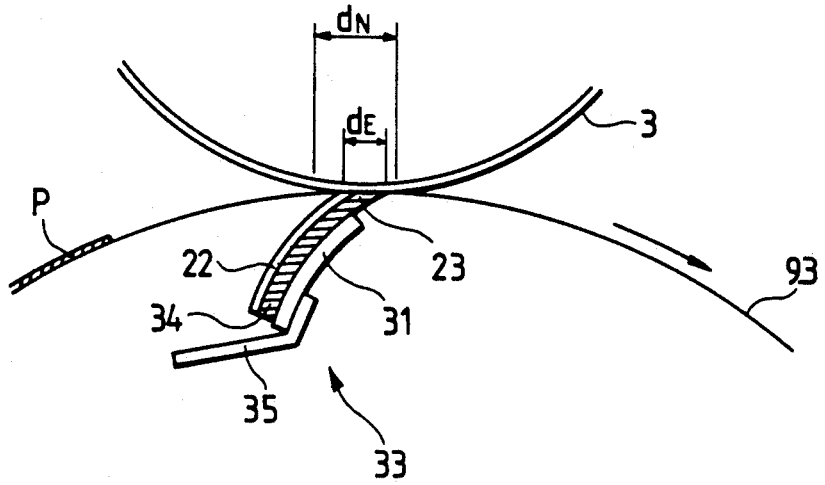
FIG. 12 is an enlarged elevational sectional view of a portion of FIG. 11.

Further, as shown in FIG. 12, since the conductive brush 23 is abutted against the dielectric sheet 93 in an inclined fashion, it is not feared that the fine fibers in the brush 23 will come down, thus maintaining the proper contact between the brush and the dielectric sheet 93. The image formed on the transfer sheet is excellent, without the irregularity in image density, discharge void, irregularity in color, discrepancy in colors, scattering of toner and transfer void at the leading end of the image.

Figure 13:
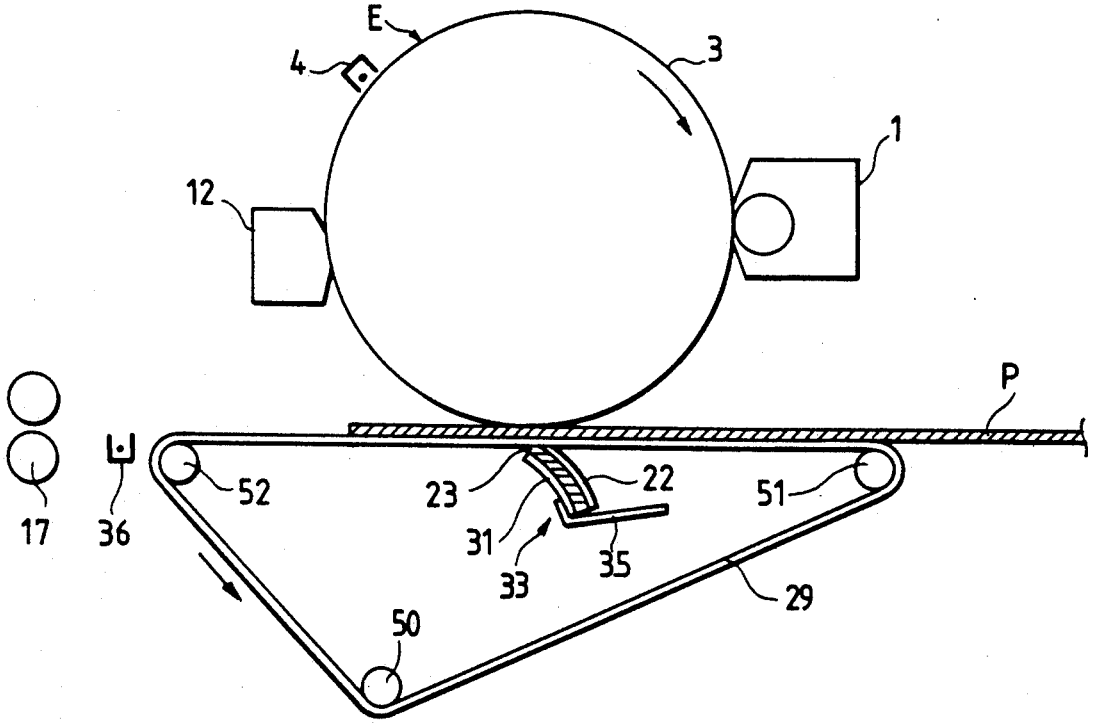
FIG. 13 is a schematic elevational sectional view of an image forming apparatus according to a tenth embodiment of the present invention.

FIG. 13 shows another embodiment of an image forming apparatus according to the present invention. In this embodiment, a transfer sheet bearing member is constituted by an endless transfer belt 29 mounted around rollers 50, 51, 52 and extending therebetween. The transfer belt is moved synchronous with the photosensitive drum 3. The transfer belt 29 is abutted against or disposed in the vicinity of the photosensitive drum 3 to define an image transfer station therebetween. At the image transfer station, a transfer electric field generating means 33 the same as that of FIG. 12 is disposed inside (back side) of the endless transfer belt 29. Similar to the embodiment of FIG. 12, the transfer electric field generating means 33 comprises a conductive brush 23, an elastic dielectric sheet 31 supporting the brush, and an electric field regulating member 22 disposed between the conductive brush 23 and the transfer belt 29, and is supported by a support member 35.

The image forming operation effected by this image forming apparatus is fundamentally the same as that of the aforementioned apparatus, except that the transfer belt 29 is used in place of the transfer drum 9 including the dielectric sheet 93. That is to say, the surface of the photosensitive drum 3 is uniformly charged by the primary charger 4, and an electrostatic latent image is formed on the photosensitive drum by illuminating the light image E corresponding to the image information by means of the exposure means. Then, the electrostatic latent image is developed with the aforementioned toner in the developing device 1 to form the toner image on the photosensitive drum 3. By the rotation of the photosensitive drum 3, when the toner image is brought into the transfer station, the electric field is applied to the image transfer station and the toner image on the photosensitive drum 3 is transferred onto the transfer sheet P carried by the transfer belt 29.

After the toner image is transferred to the transfer sheet, the latter is conveyed away from the image transfer station by a conveying force of the transfer belt 29 to reach the downstream end of the transfer belt, where the transfer sheet is separated from the transfer belt 29. Then, the transfer sheet is fed to the fixing device 17, where the toner image is fixed to the transfer sheet. Then the transfer sheet is ejected out of the image forming apparatus. It is feared that, when the transfer sheet P is separated from the transfer belt 29, the toner is scattered onto the image due to the peeling discharge. To avoid this, a charge removing charger 36 is disposed in the vicinity of a position where the transfer sheet is separated from the transfer belt 29, so that the charges can be removed from the transfer sheet and the transfer belt. After the transferring operation, the residual toner remaining on the photosensitive drum 3 is removed by the cleaning device 12 in preparation for the next image formation.

Also in this embodiment, similar to the aforementioned embodiments, since the toner image on the photosensitive drum 3 is transferred onto the transfer sheet P while generating the transfer electric field at the image transfer station by applying the voltage to the conductive brush 23 urged against the back surface of the dielectric sheet 93 via the elastic sheet 31 and blocking the transfer electric field at the area upstream of the image transfer station by the electric field regulating member 22 of the transfer electric field generating means 33, an excellent image without the irregularity in image density, discharge void, irregularity in color, discrepancy in colors, scattering of toner and transfer void at the leading end of the image can be obtained. Further, the generation of ozone is also prevented.

Incidentally, it should be noted that the transfer electric field generating means 33 of FIG. 12 can be used in place of the transfer members 23*a*–23*d* of FIG. 5.

As mentioned above, while the present invention was explained in connection with various embodiments thereof, the present invention is not limited to such embodiments, and, therefore, various alterations and modifications can be effected without departure from the scope of the present invention.

What is claimed is:

1. An image forming apparatus comprising:

an image bearing member;

image forming means for forming a toner image on said image bearing member;

movable transfer sheet bearing means for bearing a transfer sheet;

an electrically conductive transfer member for transferring a toner image formed on said image bearing member onto a transfer sheet carried by said transfer sheet bearing means through a transfer electric field generated at a transfer station, said transfer member being engageable with said transfer sheet bearing means at a side opposite said image bearing member at said transducer station; and a regulating member for regulating the transfer electric field, said regulating member having a dielectric member disposed adjacent said transfer member and upstream of the transfer station in a moving direction of said transfer sheet bearing means.

2. An image forming apparatus according to claim 1, further including an electric power source for supplying an electric power to said transfer member to generate the transfer electric field.

3. An image forming apparatus according to claim 1, wherein the volume resistivity of said transfer member is $10^{10}$ Ωcm or less.

4. An image forming apparatus according to claim 1, wherein the volume resistivity of said transfer member is $10^{8}$ Ωcm or less.

5. An image forming apparatus according to claim 1, wherein said regulating member has a second dielectric member disposed adjacent said transfer member and downstream of the transfer station in a moving direction of said transfer sheet bearing means.

6. An image forming apparatus according to claim 1, wherein an average volume particle diameter of the toner is 3 to 10 μm.

7. An image forming apparatus according to claim 1, wherein said dielectric member is a sheet contacting said transfer sheet bearing means.

8. An image forming apparatus according to claim 1, wherein said transfer sheet bearing means includes a dielectric sheet for bearing the transfer sheet.

9. An image forming apparatus according to claim 8, wherein said transfer sheet bearing means has a frame elongated in a direction crossing the moving direction of said transfer sheet bearing means, so as to support the dielectric sheet.

10. An image forming apparatus according to claim 9, wherein, when said transfer sheet bearing means moves, said frame contacts said regulating member just before contacting said transfer member.

11. An image forming apparatus according to claim 1, wherein a plurality of toner images are transferred and superimposed on the transfer sheet carried by said transfer sheet bearing means.

12. An image forming apparatus according to claim 11, wherein, after the transferring and superimposing, a full-color image is formed on the transfer sheet.

13. An image forming apparatus according to claim 1 or 12, further including an elastic sheet for supporting said transfer member and for urging said transfer member against said transfer sheet bearing means

14. An image forming apparatus according to claim 13, wherein said elastic sheet is dielectric.

15. An image forming apparatus according to claim 1, wherein said transfer member comprises a fiber brush.

16. An image forming apparatus according to claim 15, wherein said fiber brush abuts said transfer sheet bearing means in a direction normal to the moving direction thereof.

* * * * *

UNITED STATES PATENT AND TRADEMARK OFFICE

CERTIFICATE OF CORRECTION

PATENT NO. : 5,249,022

DATED : September 28, 1993

INVENTOR(S) : WATANABE ET AL.

It is certified that error appears in the above-indentified patent and that said Letters Patent is hereby corrected as shown below:

On title page, item [22] Filed:

Change "Nov. 21, 1992" to --Nov. 21, 1991--.

At [30] Foreign Application Priority Data

Change "Jun. 13, 1991 [JP] Japan....3-168893" to --Jun. 13, 1991 [JP] Japan....3-168883--.

On title page, item [54] and col. 1, lines 2-5, should read as follows:

--IMAGE FORMING DEVICE HAVING AN ELECTRICALLY CONDUCTIVE TRANSFER MEMBER AND A DIELECTRIC REGULATING MEMBER DISPOSED AT A TRANSFER STATION THEREOF--

Column 1

Line 58, change "reproductibity" (both occurrences) to --reproducibility--.

Column 2

Line 25, delete "the toner that".
Line 66, change "since" to --since the--.

UNITED STATES PATENT AND TRADEMARK OFFICE

CERTIFICATE OF CORRECTION

PATENT NO. : 5,249,022

DATED : September 28, 1993

INVENTOR(S) : WATANABE ET AL.

It is certified that error appears in the above-indentified patent and that said Letters Patent is hereby corrected as shown below:

Column 3

Line 3, change "toner," to --toner--.
Line 54, change "densiy," to --density,--.

Column 8

Line 68, change "dielctric" to --dielectric--.

Column 9

Line 30, change "mixing-" to --mixing--.

Column 10

Line 15, change "an" (first occurrence) to --a--.
Line 68, change "belt 93" to --belt 93'--.

Column 11

Line 39, change "characteristic,," to --characteristic--.
Line 48, change "belt 93" to --belt 93'--.
Line 55, change "sheet 93'," to --sheet 93,--.

Column 12

Line 27, change "position" to --position.--
Line 64, change "$10^8$-$10^{16}$≠cm" to --$10^8$-$10^{16}$ Ωcm--.

UNITED STATES PATENT AND TRADEMARK OFFICE

CERTIFICATE OF CORRECTION

PATENT NO. : 5,249,022

DATED : September 28, 1993

INVENTOR(S) : WATANABE ET AL.

It is certified that error appears in the above-indentified patent and that said Letters Patent is hereby corrected as shown below:

Column 14

Line 58, change "againt" to --against--.

Column 15

Line 14, change "sheet 83" to --sheet 93--.
Line 29, change "carried," to --carried--.

Column 17

Line 13, change "transducer" to --transfer--.

Column 18

Line 25, close up right margin.
Line 26, close up left margin.
Line 27, close up left margin and change "means" to --means.--.

Signed and Sealed this

Sixteenth Day of August, 1994

Bruce Lehman

*Attest:*

BRUCE LEHMAN

*Attesting Officer*

*Commissioner of Patents and Trademarks*